United States Patent [19]

Bruton

[11] Patent Number: 4,765,264

[45] Date of Patent: Aug. 23, 1988

[54] NEEDLE PUNCH FOR PRODUCING DECORATIVE THREAD DESIGNS

[75] Inventor: James D. Bruton, Seminole, Fla.

[73] Assignee: Creative Wonders, Inc., Clearwater, Fla.

[21] Appl. No.: 89,885

[22] Filed: Aug. 27, 1987

[51] Int. Cl.[4] ..... D05C 15/06

[52] U.S. Cl. ..... 112/80.05

[58] Field of Search ..... 112/80.03, 80.05; 66/116, 117, 118, 1; 128/340; 223/104; 69/20; 12/103

[56] References Cited

U.S. PATENT DOCUMENTS

| | | | |
|---|---|---|---|
| 4,135,458 | 1/1979 | Samoilov | 112/80.05 |
| 4,306,510 | 12/1981 | O'Brien | 112/80.05 |
| 4,479,445 | 10/1984 | Walker | 112/80.07 |

*Primary Examiner*—Ronald Feldbaum

*Attorney, Agent, or Firm*—Joseph C. Mason, Jr.

[57] ABSTRACT

A four component part adjustable needle punch is presented with each part in threaded interrelationship. A hollow needle is embedded in a plastic needle housing seated within a guide housing. A cylindrical interior housing is threaded at its front end to the needle housing and thereby controls adjustment of the needle length. A cylindrical exterior housing is threaded at its front end to the guide housing and is used to prevent movement of the needle housing when fully seated.

9 Claims, 3 Drawing Sheets

NEEDLE PUNCH FOR PRODUCING DECORATIVE THREAD DESIGNS

BACKGROUND OF THE INVENTION

1. Field of the Invention.

This invention relates to a needle punch. More specifically, it refers to a needle punch for embroidery having four adjustable component parts in threaded interrelationship.

2. Description of the Prior Art.

Adjustable needles used in fabric punch devices such as shown in U.S. Pat. Nos. 4,306,510 and 4,479,445 are well known. In U.S. Pat. No. 4,306,510 the needle is adjusted by using an adjustment wheel threadably engaged with a shank attached to the needle. Movement of the wheel causes the shank to move forward or back depending on the direction of wheel turn. Although this device achieves its intended purpose the wheel can be difficult to turn. U.S. Pat. No. 4,479,445 employs a two component unit having a protruberance on the inner surface of one component riding on helical grooves on an exterior surface of a second component to adjust a needle. The single protruberance can slip out of the helical grooves when any pressure is placed on the needle so that the needle moves at inopportune times. A needle punch is needed employing an adjustable needle easily movable, but at the same time providing a means for fixing the needle in a given position without movement when pressure is exerted on the needle.

SUMMARY OF THE INVENTION

I have invented an improved adjustable four component needle punch which is easy to operate and fixes the needle in a given position to prevent movement during an embroidery step.

My punch's first component is a hollow needle embedded in a hollow plastic needle housing with screw threads on the exterior surface of the needle housing. The second component is a hollow guide housing having a concave front interior end for seating a tapered front end of the needle housing. The guide housing has an elongated rear end with screw threads on its exterior surface. The third component is a cylindrical hollow interior housing with screw threads on an interior surface of its front end engaging the screw threads on the needle housing. The fourth component is a cylindrical hollow exterior housing with screw threads on an interior surface of its front end engaging the screw threads of the guide housing and used to lock the needle in a given position. Turning a projecting rear end of the interior housing when the exterior housing is not fully turned down causes movement of the needle along the axis of the four component parts.

DESCRIPTION OF THE DRAWINGS

The present invention may be best understood by those having ordinary skill in the needle punch art by reference to the following detailed description when considered in conjunction with the accompanying drawings in which.

DESCRIPTION OF THE PREFERRED EMBODIMENT

Figure 1:
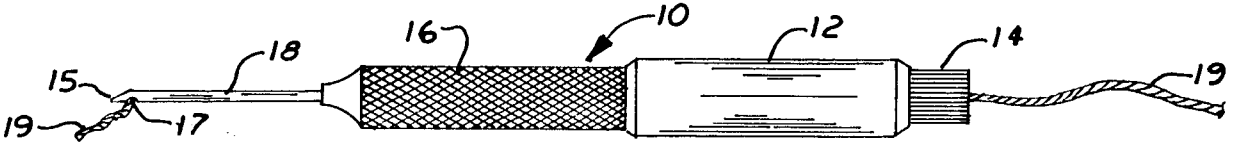
FIG. 1 is a side view of the needle punch of this invention.

The needle punch 10 of my invention contains four component parts. The first component is the needle housing 20 having a needle 18 embedded at the needle's proximal end 11 in the front end 13 of the plastic needle housing 20. The distal end 15 of needle 18 has an eye 17 through which yarn 19 is threaded. The interior of the needle housing 20 is hollow as is needle 18 to allow passage of the yarn 19. The top and bottom exterior surface 22 of needle housing 20 is threaded. There are two or more ribs or breaks 56 on the front of threads 22 to prevent retraction of needle housing 20 too far into interior housing 14. The front end 13 of the needle housing 20 is tapered so that it will seat in a concave cavity 23 at the front end of the second component, guide housing 16. Guide housing 16 is also hollow to allow passage of the yarn and has an elongated rear end 25 which contains threads 40 on its exterior surface. The front interior half 58 of the guide housing 16 seats the side surfaces 60 (not threaded) of the needle housing 20. This configuration prevents the needle housing 20 from rotating in the guide housing 16. Accordingly, the needle housing 20 only moves longitudinally.

The third component is the interior housing 14 having a first end 28 and a back end 30. Interior surface 26 of the first end 28 has a threaded area 24 engaging the threaded surface 22 on the needle housing 20. The rear end 30 of interior housing 14 projects outwardly. The outwardly projecting portion 30 is used to turn the interior housing either clockwise or counterclockwise so as to move the needle 18 in or out along the axis of the component parts. As presently designed, clockwise rotation retracts needle 18 and counterclockwise rotation projects needle 18. However, the direction of rotation can be changed by the manner in which the threads are designed.

Figure 2:
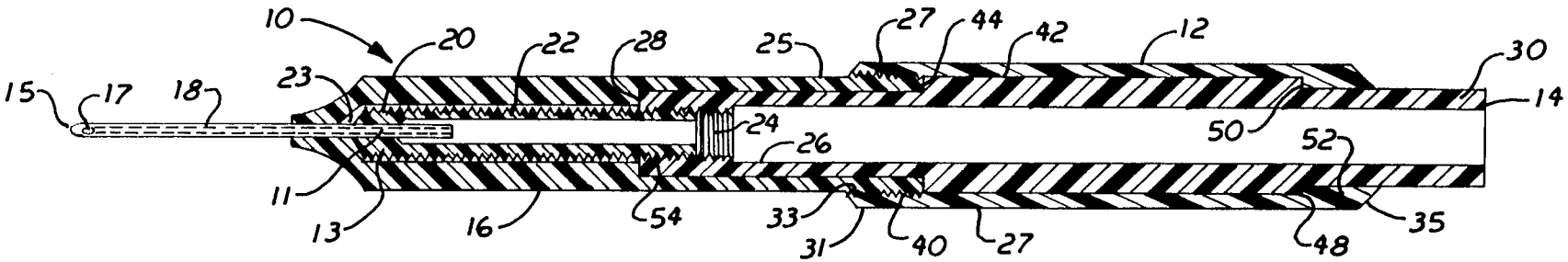
FIG. 2 is a longitudinal enlarged section view of the needle punch of this invention.
Figure 2A:
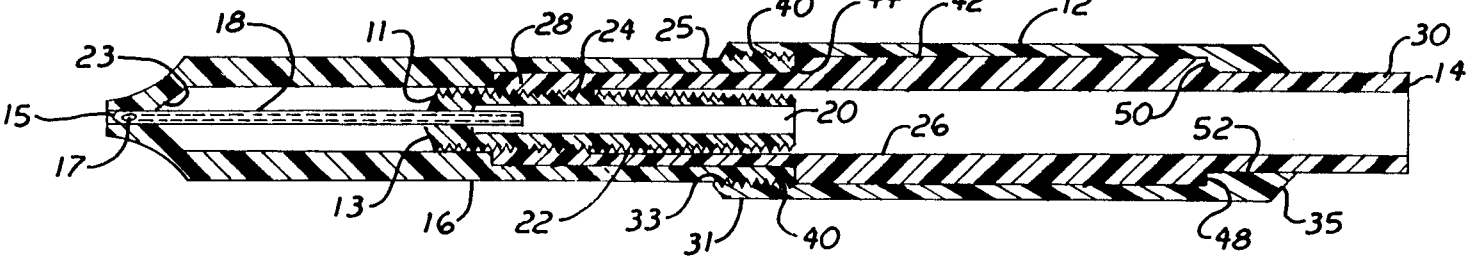
FIG. 2A is a longitudinal enlarged section view showing the device of this invention with the needle retracted.
Figure 3:
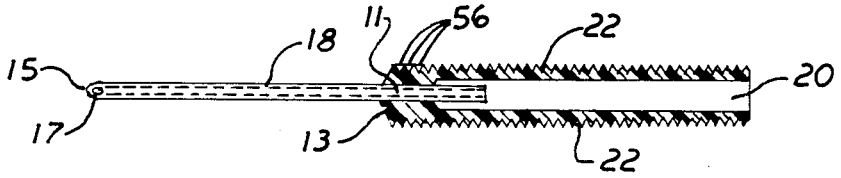
FIG. 3 is a longitudinal enlarged section view of the needle housing.
Figure 4:
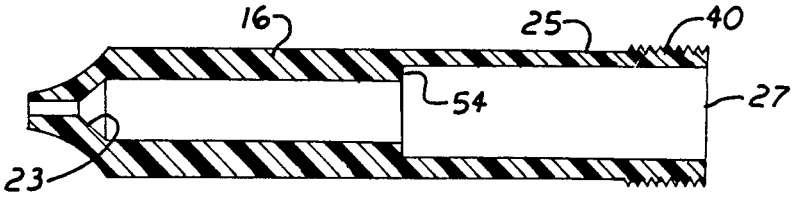
FIG. 4 is a longitudinal enlarged section view of the guide housing.
Figure 5:
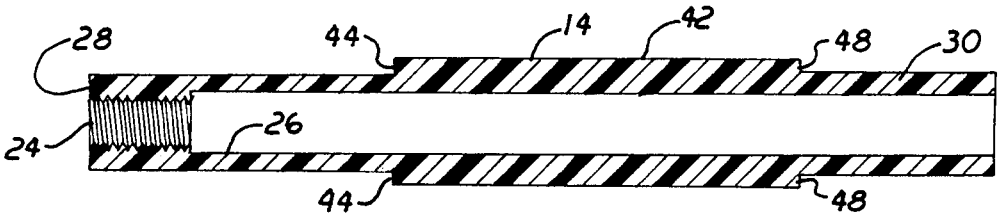
FIG. 5 is a longitudinal enlarged section view of the interior housing.
Figure 6:
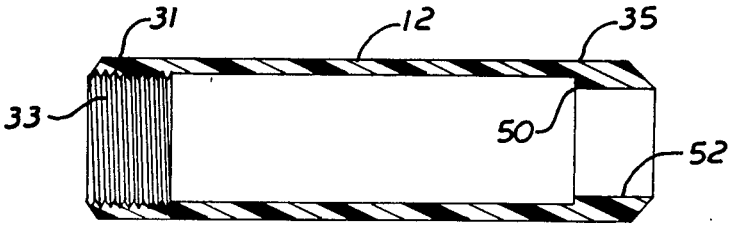
FIG. 6 is a longitudinal enlarged section view of the exterior housing.
Figure 7:
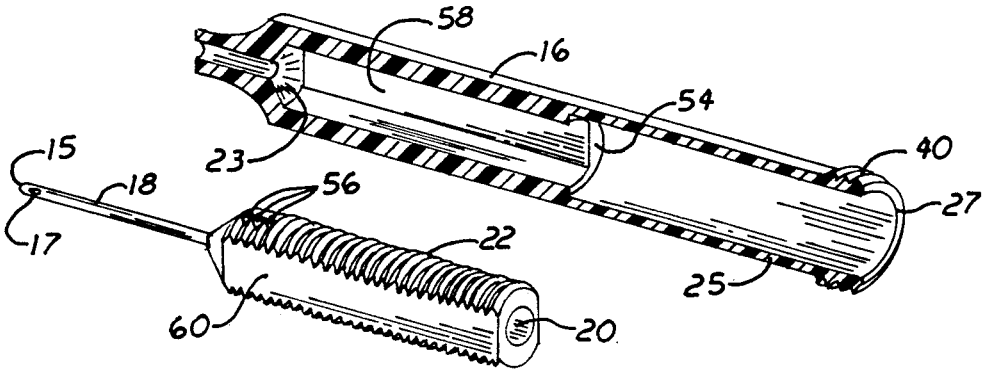
FIG. 7 is an exploded perspective of the needle housing and section of the guide housing.
Figure 8:
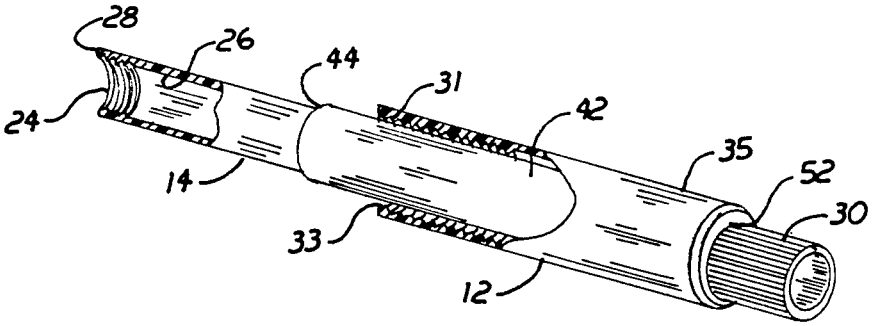
FIG. 8 is a partially cut away view of the interior and exterior housings in cooperative engagement.

Interior housing 14 has a pair of first and second step stops circumscribing an exterior surface 42. The first stop 44 engages the rear end 27 of the guide housing 16. When this stop is engaged, further turning of the interior housing 14 in a counterclockwise direction allows the needle 18 to be moved outwardly to its furthest extension. When needle housing 20 is seated in the concave portion 23 of the guide housing 16 the needle can be extended no further. At this extended position, the front end 28 of the interior housing 14 butts up against stop 54 on the guide housing 16. Clockwise rotation of the interior housing 14 moves the needle housing 20 away from the concave surface 23 of the guide housing 16 and causes the needle 18 to be retracted. See FIG. 2A. In the fully retracted position, the needle housing 20 is substantially inside the front end 28 portion of the interior housing 14 with only the tapered end 13 projecting outside the interior housing 14 into the guide housing 16.

The fourth component is exterior housing 12 having a front first end and a rear second end. The first end 31 has a threaded interior surface 33 engaging the threaded surface 40 on the guide housing 16. Turning the exterior housing 12 clockwise causes the engagement of the threads 33 with the threads 40. As full engagement is achieved, a locking action occurs preventing any rotation of the interior housing 14. An annular inner projection 52 on the second end 35 of the exterior housing has a front edge 50 engaging stop 48 on the interior housing 14 when the exterior housing is fully seated around the interior housing. Further movement of the interior housing 14 is thus prevented.

The punch device 10 of this invention is operated by threading yarn 19 through eye 17 so that it exits through the hollow rear end 30 of the interior housing 14. Thereafter, the needle is adjusted by a turning of interior housing 14 until the proper loop size is achieved by the length of needle exposed. Thereafter, the exterior housing 12 is tightened down on the interior housing 14 so that the needle cannot move any further. The looping operation is then begun. When the pattern is to be changed or the loop size is to be either made smaller or larger, the exterior housing is released and the interior housing is turned until the proper length of needle exposure is achieved. Thereafter, the exterior housing is locked down again and the needle 18 is positioned for further work.

The four components of my invention are made of a plastic substance such as a polyester, high density polyethylene, polyamide, ABS or like substance lending itself to injection molding. The molds are prepared in accordance with standard state of the art procedures. The component parts can be manufactured in great quantities at low cost. The steel needle is embedded within the needle housing at its proximal end 11 in accordance with state of the art procedures.

My needle punch can be easily assembled and easily disassembled using minimum manual dexterity. Therefore, the needle punch can be used by most people who are able to manipulate their fingers. Minor changes and modifications of my device can be made without departing from the structure described above.

Having thus defined the invention, what is claimed and desired to be secured by Letters Patent is:

1. A needle punch for producing decorative thread designs comprising:

a hollow needle partially embedded in a hollow plastic needle housing having a front end enclosing a proximal end of the needle and the needle housing having screw threads on an exterior surface;

a hollow guide housing, an exterior front surface of the needle housing juxtaposed to the front inner surface of the guide housing when the needle is fully extended, the guide housing having an elongated rear end with screw threads on its exterior surface;

a cylindrical hollow interior housing having a first end and a second end, the first end having screw threads on an interior surface engaging the screw threads on the needle housing;

a cylindrical hollow exterior housing having a first end and a second end, the first end having screw threads on an interior surface engaging the screw threads on the guide housing, the interior housing being rotatable within the exterior housing when the exterior housing screw threads are not fully engaged and the second end of the interior housing projecting outwardly from the second end of the exterior housing.

2. A needle punch according to claim 1 wherein the needle housing has a tapered front end conforming in shape to a concave shaped notch in the front inner surface of the guide housing.

3. A needle punch according to claim 1 wherein the rear end of the guide housing engages a stepped stop on an exterior surface of the interior housing.

4. A needle punch according to claim 1 wherein the second end interior surface of the exterior housing is notched to engage with a stepped stop on a second end exterior surface of the interior housing.

5. A needle punch according to claim 1 wherein the needle end distal from the needle housing has a needle eye through which a length of yarn passes outward from the hollow interior of the needle.

6. A needle punch for producing decorative thread designs comprising:

a hollow needle embedded in a hollow plastic needle housing at a proximal end and having an eye for passage of a thread at a distal end;

the needle housing having a tapered front end and screw threads on an exterior surface;

a hollow guide housing having a concave front interior end for seating the tapered front end of the needle housing when the needle is fully extended, the guide housing having an elongated rear end with screw threads on its exterior surface;

a cylindrical hollow interior housing having a first end and a second end, the first end having screw threads on an interior surface engaging the screw threads on the needle housing and a first and second stepped stop circumscribing an exterior surface, the first stop in a forward portion and the second stop in a rear portion of the interior housing, the first stop engaging the rear end of the guide housing;

a cylindrical hollow exterior housing having a first end and a second end, the first end having screw threads on an interior surface engaging the screw threads on the guide housing, the interior housing being rotatable within the exterior housing when the exterior housing screw threads are not fully engaged and the second end of the interior housing projecting outwardly from the second end of the exterior housing and through which thread feeds to the needle eye, the exterior housing having an inwardly projecting annular member on the interior wall of the rear portion engaging the second stop of the interior housing when the exterior housing is fully seated.

7. A needle punch according to claim 6 wherein the needle housing has four exterior surfaces, two opposed surfaces having threads and two opposed surfaces being planar.

8. A needle punch according to claim 7 wherein the two planar surfaces are juxtaposed to planar interior surfaces of the guide housing.

9. A needle punch according to claim 6 wherein the screw threads on the needle housing adjacent the tapered front end have ribs to prevent retraction into the interior housing.

* * * * *